US007415773B2

(12) United States Patent
Abdilla et al.

(10) Patent No.: US 7,415,773 B2
(45) Date of Patent: Aug. 26, 2008

(54) METHOD AND APPARATUS FOR GAUGING BODY SIZE

(75) Inventors: Richard Abdilla, Staplecross (GB); Lara Rudd, Staplecross (GB)

(73) Assignee: RLJ Design Limited, East Sussex (GB)

( * ) Notice: Subject to any disclaimer, the term of this patent is extended or adjusted under 35 U.S.C. 154(b) by 70 days.

(21) Appl. No.: 10/572,245

(22) PCT Filed: Sep. 17, 2004

(86) PCT No.: PCT/GB2004/003985

§ 371 (c)(1),
(2), (4) Date: Mar. 17, 2006

(87) PCT Pub. No.: WO2005/025353

PCT Pub. Date: Mar. 24, 2005

(65) Prior Publication Data

US 2006/0254067 A1 Nov. 16, 2006

(30) Foreign Application Priority Data

Sep. 18, 2003 (GB) ..... 0321878.1

(51) Int. Cl.
*A61B 5/103* (2006.01)
*A41H 1/02* (2006.01)

(52) U.S. Cl. ..... 33/512; 33/2 R

(58) Field of Classification Search ..... 33/2 R, 33/11, 13, 512, 514.1
See application file for complete search history.

(56) References Cited

U.S. PATENT DOCUMENTS 1,212,279 A * 1/1917 Stone ..... 33/565
1,221,302 A * 4/1917 Fischer ..... 33/13
1,248,510 A * 12/1917 Levi ..... 33/2 R
2,537,417 A * 1/1951 Merske ..... 33/2 R
2,725,633 A * 12/1955 Graf ..... 33/2 R
3,327,394 A * 6/1967 Tenteris ..... 33/2 R
3,685,155 A * 8/1972 Oblander ..... 33/11
3,979,831 A * 9/1976 Lutz ..... 33/11
4,024,856 A * 5/1977 Kirianoff ..... 33/512
4,224,740 A 9/1980 Gibson ..... 33/17
4,417,401 A * 11/1983 Aisaka et al. ..... 33/512

(Continued)

FOREIGN PATENT DOCUMENTS

JP 04126808 A * 4/1992 ..... 33/2 R (Continued)

*Primary Examiner*—G. Bradley Bennett
(74) *Attorney, Agent, or Firm*—McCormick, Paulding & Huber LLP

(57) ABSTRACT

A plurality of body sizers comprise sample garments for temporary wear made of a different material to a corresponding plurality of garments for long-term wear. Each of the garments for long-term wear is made to a predetermined size based on the size of a respective one of the body sizers. The most appropriately sized one of the garments for long-term wear may be selected by gauging which of the body sizers is the best match to the actual size of at least part of a person's body. A body sizer comprises a sample garment for temporary wear formed into a single integral piece and comprises means for indicating a plurality of different predetermined sizes on which the sizes of a corresponding plurality of garments for long-term wear are based.

20 Claims, 2 Drawing Sheets

U.S. PATENT DOCUMENTS

| | | | | |
|---|---|---|---|---|
| 5,353,513 | A * | 10/1994 | Round | 33/514.1 |
| 5,531,028 | A | 7/1996 | Flippen | 33/1 |
| 6,279,244 | B1 * | 8/2001 | Kelley | 33/514.1 |
| 2002/0157273 | A1 * | 10/2002 | Noyes | 33/512 |
| 2002/0166254 | A1 | 11/2002 | Liebermann | 33/759 |

FOREIGN PATENT DOCUMENTS

| | | |
|---|---|---|
| JP | 2002-317322 | 10/2002 |
| JP | 2002-339113 | 11/2002 |

* cited by examiner

METHOD AND APPARATUS FOR GAUGING BODY SIZE

CROSS REFERENCE TO RELATED APPLICATIONS

This application is entitled to the benefit of and incorporates by reference essential subject matter disclosed in International Patent Application No. PCT/GB2004/003985 filed on Sep. 17, 2004 and Great Britain Patent Application No. 0321878.1 filed Sep. 18, 2003.

FIELD OF THE INVENTION

The present invention relates to a method and apparatus for use in gauging body size. In particular, the present invention relates to a sample garment, or sizer, of a standard size. It is envisaged that a particularly useful application of the sizer will be in purchasing clothing.

BACKGROUND OF THE INVENTION

It can often be difficult for a customer to select an appropriately sized garment, such as a pair of trousers, if the garment cannot be tried on. For example, where a customer orders a garment from a mail order catalogue, it is often the case that the garment, once delivered, does not fit the customer. This results in many items being returned to the supplier. This is inconvenient for the customer and expensive for the supplier. There are many different suppliers of clothing and, even when using uniform standard sizing systems, each supplier's products are not necessarily the same size as those of another supplier. This makes it even more difficult for the customer to choose an appropriate size.

Difficulties also arise where it is not possible for a clothing outlet to include changing rooms on their premises—for example, in a particularly small shop. Even where changing room facilities are provided, they are often inadequate (particularly at very busy times, such as during a sale) and customers have to queue for some time to try clothing on.

Several methods have been proposed to overcome the problem of ill-fitting clothing. For example, methods to determine body measurements in order to provide garments that accurately fit an individual have been proposed. For example US 2002/0166254 A1 discloses a stretch bodysuit which provides uniform markings at which accurate body measurements can be taken using a tape measure. The measurements are used to produce a custom-made garment. This system, however, is not useful to suppliers that produce a set range of sizes, such as mail order companies, or clothing retailers.

It is also known, as disclosed in JP2002-212823 for example, to provide a customer with samples of sections of a garment. The customer can then select the most appropriate size for each section from the samples provided, and custom-made garment is supplied. However, this is also unsuitable for mass-manufacturing or mail order clothing companies who do not seek to supply custom-made clothing.

It is not known, however, to provide a method whereby a customer can select a correctly sized garment produced by a particular company without trying it on.

BRIEF SUMMARY OF THE INVENTION

The present invention seeks to overcome these problems by providing a system whereby a customer can gauge their body size in relation to standard size garments produced by one or more clothing company.

According to the present invention, there is provided a sizing guide, or sizer, comprising a sample garment which conforms to a predetermined size, wherein the sizer is made from a low-stretch material. By using a low-stretch material the customer can gain a more accurate determination of their body size in relation to the sizer. It can be envisaged that a particular company, such as a mail order clothing company or clothing shop, would supply sizers in a plurality of predetermined sizes to its customers. The body size of a customer can then be gauged, and future garments can be purchased from the company without being first tried-on.

In one embodiment, the sizer conforms to International size standards. In another embodiment, the sizer conforms to a standard size of a particular company. In this embodiment, it is preferable that the sizer indicates the corresponding size as produced by one or more other company.

Preferably, the garment sizer is made from a lightweight material. Suitably, the garment sizer is disposable. More preferably the garment sizer is made from a non-woven fabric.

According to another aspect of the present invention, there is provided a method for purchasing a garment by enabling a customer to gauge their body size in relation to garments produced by a particular company comprising the steps of: (i) supplying to the customer at least two sizers, each comprising a sample garment made from a low-stretch material which conforms to a predetermined size; (ii) selection of the sizer which conforms most accurately to the body sizer of the customer; (iii) and supply of clothing to the customer in the appropriate size.

In one embodiment, the sizers are supplied with a mail order clothing catalogue. In another embodiment, sizers are supplied by a clothing outlet or shop.

Preferably, the sizer is made from a lightweight material. Suitably, the sizer is disposable. More preferably the garment sizer is made from a non-woven fabric.

Suitably, the sizer may be a pair of trousers or a shirt. In the preferred embodiment, the sizer further comprises means for indicating a plurality of leg or sleeve lengths. Preferably, the indicating means comprise perforations. Alternatively, the indicating means comprise cutting lines. The cutting lines may be formed by, for example, stitching. Further, it is preferred that the sizer has detachable portions to represent, for example, different necklines. The customer will therefore also be able to gain an indication of how a particular style of garment fits. Advantageously, the detachable portions are removable by means of perforations or cutting lines.

Optionally, the sizer comprises means for indicating more than one predetermined size. In a particular embodiment, the sizer has means for indicating a plurality of shoulder-strap lengths. Suitably, a strap length is indicated by means of a removable and replaceable peg.

BRIEF DESCRIPTION OF THE DRAWINGS

A specific embodiment of the invention will now be described by way of example only and with reference to the accompanying drawings in which.

DETAILED DESCRIPTION OF THE INVENTION

Figure 1:
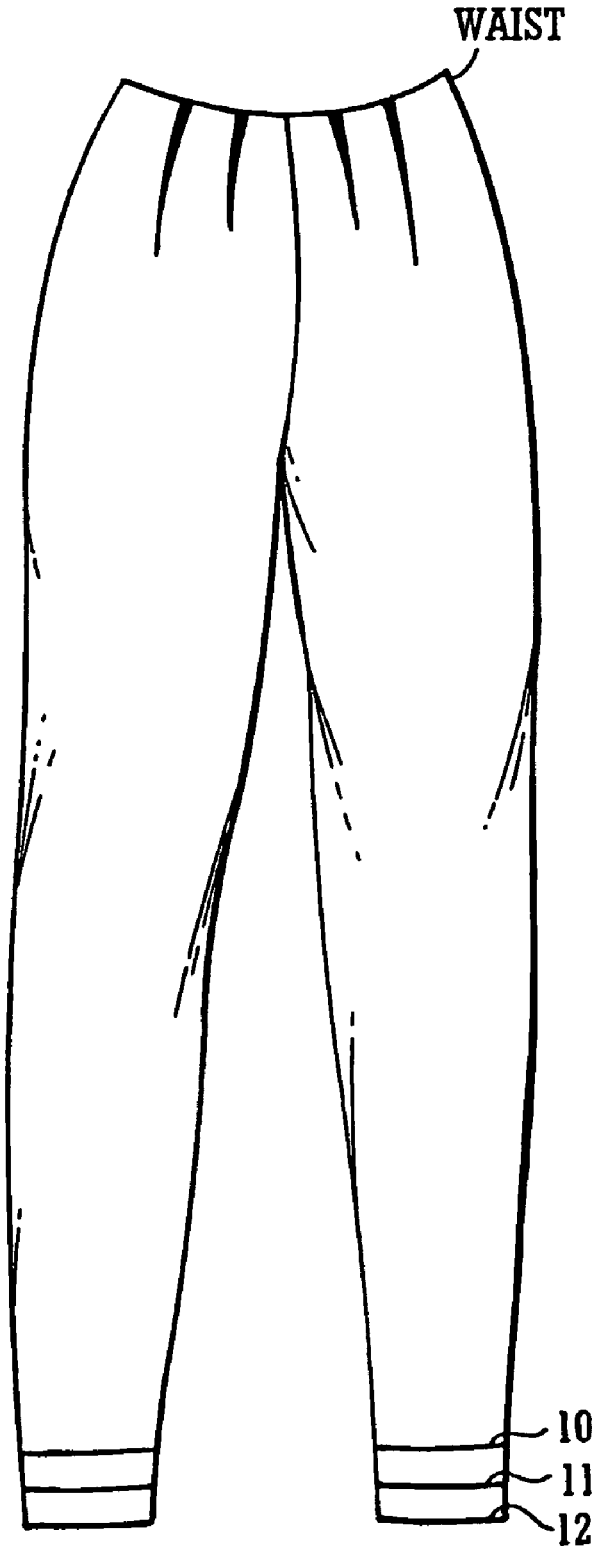
FIG. 1 is a plan view of an embodiment of a sizer in accordance with the first aspect of the present invention.

With reference to FIG. 1 there is shown a lower-body sizer in the form of a pair of trousers. The sizer provides an accurate representation of the anthropometric data on which a company's garment size will be based. A sizer is produced for each of a number of standard sizes. A customer wishing to purchase a pair of trousers from the company is provided with one or more sizer from which to select the size which accurately represents their body size.

Tear-off portions 10, 11, 12 are provided to represent different leg lengths. Portion 10 indicates a short leg length, portion 11 indicates a regular leg length and portion 12 indicates a long leg length.

The sizer is made from a low-stretch material in order that a true indication of the customer's body size is obtained. In the preferred embodiment, the sizer is made from a non-woven fabric, such as a non-woven polypropylene.

It is preferable that the sizer has a degree of durability so that it can be tried-on numerous times and retained by the customer for future reference. For this reason, in the preferred embodiment, the sizer is constructed by stitching or welding. If the body measurements of the customer change, a new sizer can be ordered.

Figure 2:
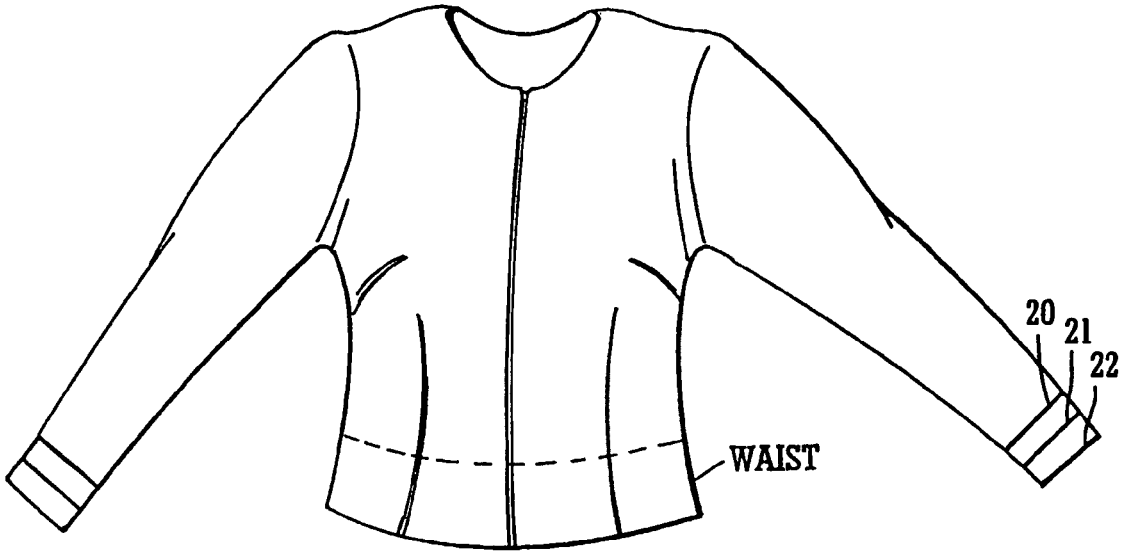
FIG. 2 is a plan view of a further embodiment of a sizer in accordance with the first aspect of the present invention.

With reference to FIG. 2, there is shown a torso sizer having sleeve tear-off portions 20, 21, 22 indicating a short (20), regular (21) and long (22) length sleeve.

Many other embodiments of the present invention are, of course, possible. For example, the present invention extends to skirts, jackets, dresses, underwear, wetsuits and uniforms. It is also possible to combine more than one garment in one garment sizer—as with the above embodiment of a trouser/shorts sizer. For example, a skirt/dress sizer would be possible.

It is envisaged that the sizer will have several applications. For example, it will be useful where a clothing supplier wishes to prevent too many customers from trying on particularly expensive or delicate item or clothing, such as a wedding dress. A further application may be in the manufacture of uniforms for the army or police, for example.

While the present invention has been illustrated and described with respect to a particular embodiment thereof, it should be appreciated by those of ordinary skill in the art that various modifications to this invention may be made without departing from the spirit and scope of the present invention.

The invention claimed is:

1. A plurality of body sizers, each of a different predetermined body size, comprising sample garments for temporary wear; and a corresponding plurality of garments for long term wear made of a different material to the body sizers;

wherein each of said garments for long term wear is made to a predetermined size based on the body size of a respective one of the body sizers such that the most appropriately sized one of said garments for long term wear may be selected by gauging which of said body sizers is the best match to the actual size of at least part of a person's body.

2. The plurality of body sizers as claimed in claim 1 wherein the body sizers are less durable than the corresponding garments for long term wear.

3. The plurality of body sizers as claimed in claim 1 wherein one of the body sizers is of a predetermined body size on which the sizes of two or more different of the corresponding garments for long term wear are based.

4. The plurality of body sizers as claimed in claim 1 made of a low-stretch material.

5. The plurality of body sizers as claimed in claim 1 made of a lightweight material.

6. The plurality of body sizers as claimed in claim 1 made of a non-woven fabric.

7. The plurality of body sizers as claimed in claim 1 made of polypropylene.

8. The plurality of body sizers as claimed in claim 1 constructed by stitching or welding.

9. The plurality of body sizers as claimed in claim 1 which are disposable.

10. The plurality of body sizers as claimed in claim 1 which are sufficiently durable that they may be worn temporarily on more than one occasion.

11. A body sizer for use in selecting the size of a garment for long term wear, said body sizer comprising a sample garment that includes a primary portion, indicia indicating a plurality of different sizes, and one or more detachable portions for selecting one of the indicated sizes, said detachable portions being attached to the primary portion by one or more lines of weakness.

12. The body sizer as claimed in claim 11 wherein the lines of weakness comprise perforations.

13. The body sizer as claimed in claim 11 made of polypropylene.

14. The body sizer as claimed in claim 11 constructed by stitching or welding.

15. A method of selecting one of a plurality of predetermined garment sizes comprising:

providing a plurality of body sizers comprising sample garments for temporary wear wherein the predetermined garment sizes are each based on the size of a respective one of the body sizers;

trying on one or more of the body sizers to gauge which is the best match to the actual size of at least part of a person's body; and selecting one of said predetermined garment sizes corresponding to the body sizer gauged to be the best match.

16. A method of selecting one of a plurality of predetermined garment sizes comprising:

providing a body sizer comprising a sample garment that includes a primary portion, indicia for indicating a plurality of different sizes, and one or more detachable portions attached to the primary portion for selecting one of the indicated sizes;

detaching one or more of the detachable portions to select one of the indicated sizes; and selecting one of the said predetermined garment sizes based on the selected size.

17. The method as claimed in claim 16 comprising tearing off one or more of the detachable portions.

18. A method of supplying a garment to a customer comprising:

providing a body sizer corresponding to one or more of a plurality of garment sizes;

the customer trying on the body sizer to gauge whether the body sizer is a good match to the actual size of at least part of the customer's body; and supplying to the customer a garment having a size based on the size of the body sizer or one of the sizes of the body sizer.

19. The method as claimed in claim 16 wherein the step of providing a body sizer further includes providing said body sizer with a mail order catalogue.

20. The method as claimed in claim 16 wherein the step of providing a body sizer further includes providing said body sizer from a clothing outlet or shop.

* * * * *